US010170027B2

(12) United States Patent
Lee

(10) Patent No.: US 10,170,027 B2
(45) Date of Patent: Jan. 1, 2019

(54) DISPLAY DEVICE

(71) Applicant: Samsung Display Co., Ltd., Yongin-si (KR)

(72) Inventor: Sangshin Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/877,459

(22) Filed: Oct. 7, 2015

(65) Prior Publication Data

US 2016/0267829 A1 Sep. 15, 2016

(30) Foreign Application Priority Data

Mar. 13, 2015 (KR) ..... 10-2015-0035085

(51) Int. Cl.
*G09G 3/20* (2006.01)

(52) U.S. Cl.
CPC ..... *G09G 3/20* (2013.01); *G09G 2300/0452* (2013.01)

(58) Field of Classification Search
CPC ..... G09G 3/2003; G09G 3/2085
USPC ..... 345/589
See application file for complete search history.

(56) References Cited

U.S. PATENT DOCUMENTS

2011/0260952 A1* 10/2011 Hwang ..... G02F 1/134336 345/55
2011/0291549 A1 12/2011 Kim et al.
2012/0092238 A1* 4/2012 Hwang ..... G09G 3/20 345/55
2013/0234917 A1* 9/2013 Lee ..... H01L 27/3216 345/82
2013/0314459 A1* 11/2013 Nakanishi ..... G09G 3/3406 345/694
2014/0111536 A1* 4/2014 Shinozaki ..... G09G 5/37 345/589
2014/0246654 A1* 9/2014 Huang ..... H01L 27/326 257/40
2015/0102297 A1 4/2015 Lee

FOREIGN PATENT DOCUMENTS

KR 10-2011-0131540 12/2011
KR 10-2014-0035239 3/2014
KR 10-2015-0042009 4/2015

* cited by examiner

*Primary Examiner* — Hai Tao Sun
(74) *Attorney, Agent, or Firm* — H.C. Park & Associates, PLC

(57) ABSTRACT

An exemplary embodiments provides a display device including; a plurality of unit areas, each unit areas including a first pixel, a second pixel, and a third pixel, wherein the first pixel, the second pixel, and the third pixel are configured to produce different colors, wherein each of the plurality of unit areas respectively includes a square shaped guideline inscribed therein, wherein the first pixel is disposed on a first side of the square shaped guideline, the first pixel extending in a first direction, and wherein the second pixel is disposed in a center region of the square shaped guideline, the second pixel extending in a second direction, the second direction crossing the first direction.

18 Claims, 4 Drawing Sheets

DISPLAY DEVICE

CROSS-REFERENCE TO RELATED APPLICATION

This application claims priority from and the benefit of Korean Patent Application No. 10-2015-0035085, filed on Mar. 13, 2015, which is hereby incorporated by reference for all purposes as if fully set forth herein.

BACKGROUND

Field

Exemplary embodiments relate to a display device.

Discussion of the Background

According to the accelerated development of display devices, the demand for a display device having high resolution, such as full high definition (FHD), quad high definition (QHD), or ultra high definition (UHD), is increasing. Accordingly, studies have been made to increase space utilization while reducing deterioration of an opening ratio according to an arrangement of pixels.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display device having a pixel array structure.

Additional aspects will be set forth in the detailed description which follows, and, in part, will be apparent from the disclosure, or may be learned by practice of the inventive concept.

Exemplary embodiments provide a display device including a plurality of unit areas each including a first pixel, a second pixel, and a third pixel. The first pixel, the second pixel, and the third pixel are configured to produce different colors. Each of the plurality of unit areas respectively includes a square shaped guideline inscribed therein, wherein the first pixel is disposed on a first side of the square shaped guideline, the first pixel extending in a first direction, and wherein the second pixel is disposed in a center region of the square shaped guideline, the second pixel extending in a second direction, the second direction crossing the first direction perpendicularly.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
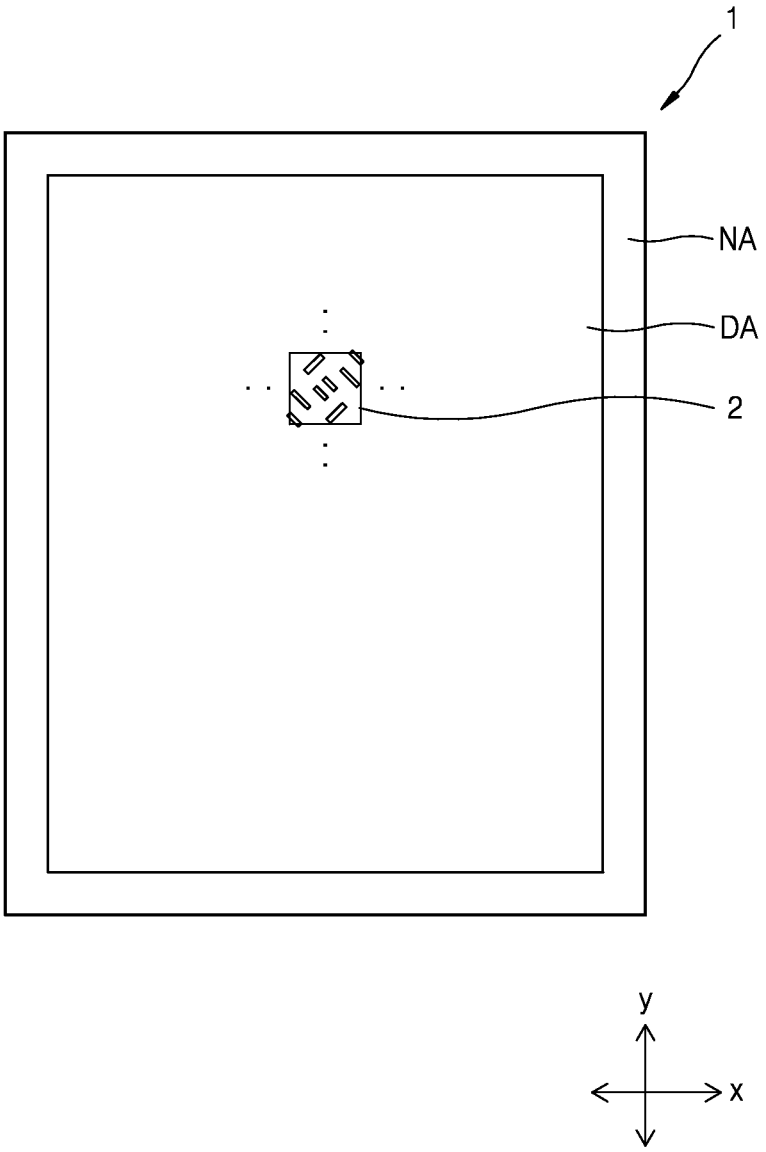
FIG. 1 is a plan view schematically illustrating a display device according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

FIG. 1 is a plan view schematically illustrating a display device 1 according to an exemplary embodiment.

Referring to FIG. 1, the display device 1 according to an exemplary embodiment may include a display area DA and a non-display area NA. The display device 1 according to the exemplary embodiment may be either a rigid flat panel display device or a flexible display device.

The display area DA includes a plurality of unit areas 2, wherein the plurality of unit areas 2 may be arranged in a matrix shape including rows and columns extending along an x-direction and a y-direction. Each unit area 2 may include a plurality of pixels producing different colors, and may generate an image through a combination of the plurality of pixels.

The non-display area NA may be disposed to surround the display area DA. Although not shown, a driver, such as a gate driver, a data driver, and/or a controller, connected to wires configured to supply signals and/or power to the plurality of pixels in the display area DA, may be disposed in the non-display area NA.

In FIG. 1, the non-display area NA surrounds the display area DA, but the exemplary embodiments are not limited thereto. According to the exemplary embodiments, the non-display area NA may be disposed adjacent to only one side of the display area DA. According to an exemplary embodiment, the display device 1 may omit the non-display area NA, which is a dead area, or may include the non-display area NA having very small area compared to that of the display area DA.

Figure 2:
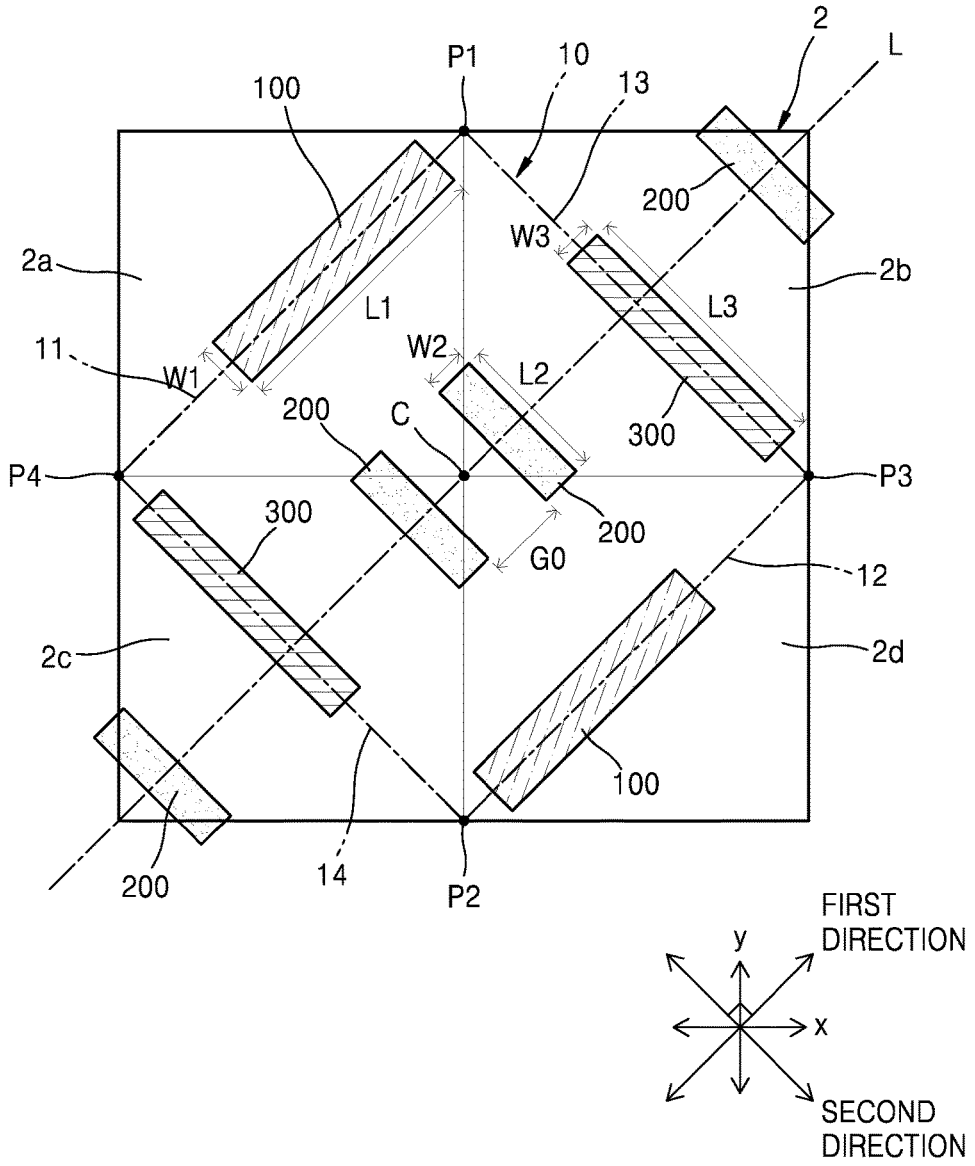
FIG. 2 is a plan view schematically illustrating a unit area included in a display area of FIG. 1.

FIG. 2 is a plan view schematically illustrating the unit area 2 included in the display area DA of FIG. 1.

Referring to FIG. 2, the unit area 2 may include a first pixel 100, a second pixel 200, and a third pixel 300, which respectively produce different colors. According to an exemplary embodiment, the unit area 2 may include the first pixel 100 producing blue color, the second pixel 200 producing green color, and the third pixel 300 producing red color. An organic light-emitting device (not shown) including an anode (not shown), an emission layer (not shown), and a cathode (not shown) may be disposed in each of the first, second, and third pixels 100, 200, and 300. According to the exemplary embodiment, the organic light-emitting device is disposed in each of the first, second, and third pixels 100, 200, and 300, but the exemplary embodiments are not limited thereto. According to an exemplary embodiment, the display device may be a liquid crystal display device including a color filter correspondingly to each of the first, second, and third pixels 100, 200, and 300.

The number of the second pixels 200 included in the unit area 2 may be equal to a sum of the numbers of first and third pixels 100 and 300. For example, the unit area 2 may include a pair of the first pixels 100, two pairs of the second pixels 200, and a pair of the third pixels 300.

The first and third pixels 100 and 300 may be disposed along a square shaped guideline 10 inscribed in the unit area 2. The unit area 2 may be a square, and divided into four sub-areas 2*a*, 2*b*, 2*c*, and 2*d* sharing a vertex. Here, the vertex shared by the sub-regions 2*a*, 2*b*, 2*c*, and 2*d* is a center point C of the unit area 2. The square shaped guideline 10 may be formed by connecting points respectively formed at midpoint of each sides of the unit area 2. First, second, third, and fourth vertices P1, P2, P3, and P4 of the square shaped guideline 10 correspond to the midpoints of the sides of the unit area 2, and first, second, third, and fourth sides 11, 2, 13, and 14 of the square shaped guideline 10 may correspond to diagonals of the first, second, third, and fourth sub-regions 2*a*, 2*b*, 2*c*, and 2*d*.

The first pixel 100 may extend along a first direction on one side of the sides of the square shaped guideline 10 inscribed in the unit area 2, extending along the first direction. For example, each of the pair of first pixels 100 may be respectively disposed on at least a part of the first side 11 of the square shaped guideline 10 and the second side 12 of the square shaped guideline 10 extending parallel to the first side 11, wherein the first pixel 100 has a first length L1 extending along the first direction.

The first pixel 100 has the first length L1 and a first width W1 extending in a second direction perpendicular to the first length L1. The first pixel 100 may have a strip shape wherein the first length L1 is larger than the first width W1. An opening ratio of the first pixel 100, which may be defined by an area of the first pixel 100, may be determined according to the first length L1 and the first width W1.

Each of the first pixels 100 disposed respectively on the first side 11 and the second side 12 may be point-symmetrical with respect to the center point C of the square shaped guideline 10. For example, the first pixel 100 disposed on the first side 11 may be disposed adjacent to the first vertex P1 located at one end of the first side 11 of the square shaped guideline 10, and the first pixel 100 disposed on the second side 12 may be disposed adjacent to the second vertex P2 that is located at one end of the second side 12, opposite to the first vertex P1 with reference to the center point C.

The second pixel 200 may be disposed in a center region of the unit area 2, for example, a center region of the square shaped guideline 10, and may extend along the second direction. The second pixel 200 has a second length L2 along the second direction, and has a second width W2 extending in the first direction perpendicular to the second length L2. The second pixel 200 may have a strip shape wherein the second length L2 is larger than the second width W2. An opening ratio of the second pixel 200, which may be defined by an area of the second pixel 200, may be determined according to the second length L2 and the second width W2.

The second pixel 200 may include two pairs of the second pixels 200. One pair of the second pixels 200 may be disposed in the center region of the square shaped guideline 10, and the other pair of the second pixels 200 may be disposed in a region outside (i.e., outer region) of the square shaped guideline 10, for example, adjacent to corners of the unit area 2. The pair of second pixels 200 disposed in the center region of the square shaped guideline 10 may be spaced apart by a center gap G0 with respect to the center point C, and the other pair of second pixels 200 disposed crossing a first diagonal guideline L of the unit area 2, which crosses the pair of second pixel 200 disposed in the center region, adjacent to the corners of the unit area 2.

The third pixel 300 may be disposed on one side of the sides of the square shaped guideline 10 inscribed in the unit area 2, extending along the second direction. For example, each of the pair of third pixels 300 may be respectively disposed on at least a part of the third side 13 of the square shaped guideline 10 and the fourth side 14 of the square shaped guideline 10 extending parallel to the third side 13, wherein each of the third pixels 300 has a third length L3 extending along the second direction.

The third pixel 300 has the third length L3 and a third width W3 extending in the first direction perpendicular to the third length L3. The third pixel 300 may have a strip shape wherein the third length L3 is larger than the third width W3. An opening ratio of the third pixel 300, which may be defined by an area of the third pixel 300, may be determined according to the third length L3 and the third width W3.

Each of the third pixels 300 disposed respectively on the third side 13 and the fourth side 14 of the square shaped guideline 10 may be point-symmetrical with respect to the center point C of the square shaped guideline 10. For example, the third pixel 300 disposed on the third side 13 may be disposed adjacent to the third vertex P3 located at one end of the third side 13 of the square shaped guideline 10, and the third pixel 300 disposed on the fourth side 14 may be disposed adjacent to the fourth vertex P4 that is located at one end of the fourth side 14, opposite to the third vertex P3 with reference to the center point C.

Figure 3:
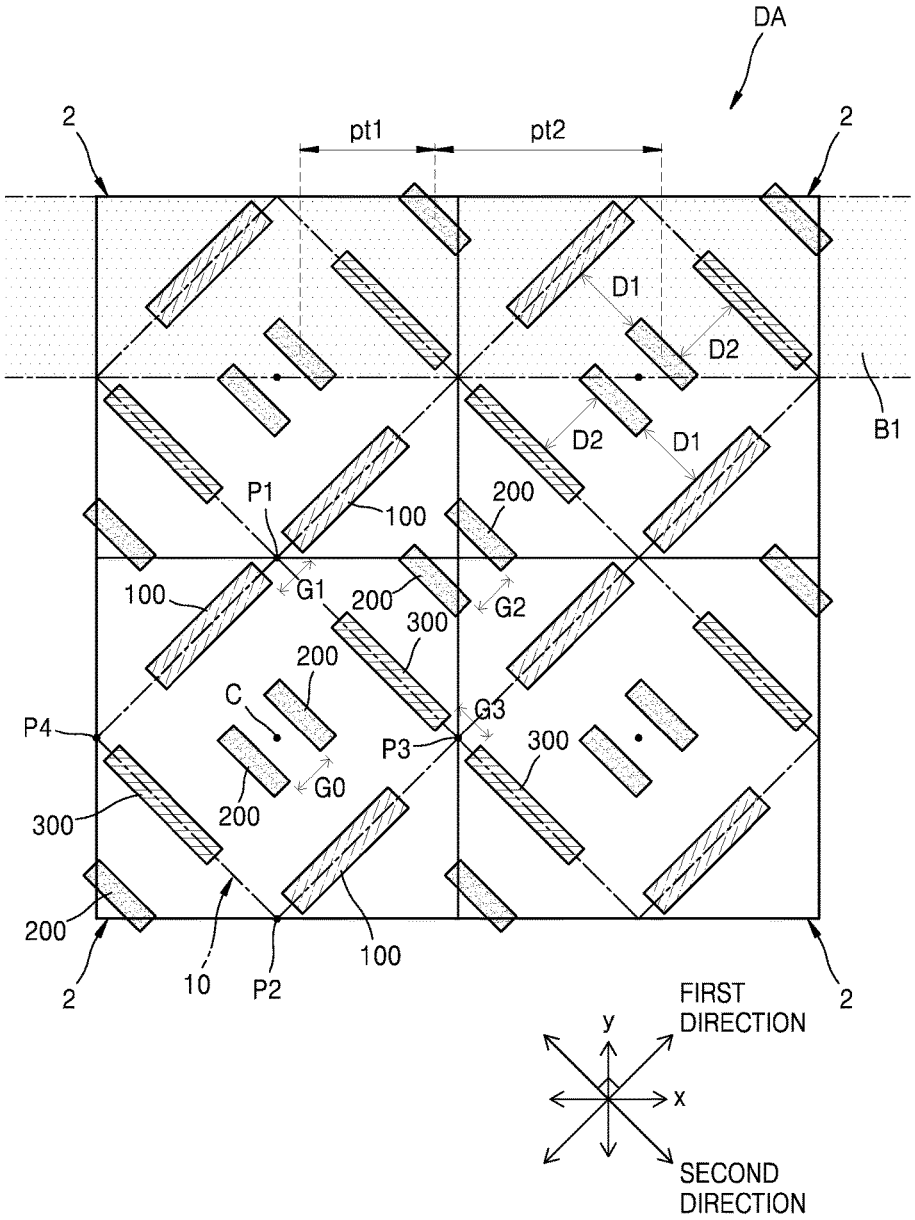
FIG. 3 is a plan view of unit areas of FIG. 2.

FIG. 3 is a plan view of unit areas 2 of FIG. 2, wherein an array structure of the first pixels 100, second pixels 200, and third pixels 300 included in the display area DA is illustrated. In FIG. 3, four unit areas 2 are arranged for convenience of description, and thus the number of unit areas 2 is not limited thereto. In FIG. 3, first and second directions correspond to a coordinate system rotated about 45° with respect to the x-axis and y-axis directions.

Referring to FIG. 3, the unit areas 2 including the first, second, and third pixels 100, 200, and 300 may be arranged in a matrix shape along x- and y-directions, wherein the display area DA of the display device 1 including the plurality of unit areas 2 may include the pluralities of the first, second, and third pixels 100, 200, and 300. The first pixels 100 extend along the first direction and the second and third pixels 200 and 300 extend along the second direction extending perpendicular to the first direction.

The first pixels 100 disposed in the neighboring unit areas 2 may be disposed adjacent to each other at a first gap G1 with a vertex of the square shaped guideline 10 as a center. For example, the first pixel 100 of one unit area 2 may be disposed adjacent to the first pixel 100 of one neighboring unit area 2 in the y-direction by the first gap G1, with the first vertex P1 (or the second vertex P2) of the square shaped guideline 10 as a center.

The second pixels 200 included in the neighboring unit areas 2 may be disposed adjacent to each other by a second gap G2 with a vertex of the unit area 2 as a center. For example, the second pixel 200 disposed in a corner region of one unit area 2 may be disposed adjacent to the second pixel 200 disposed in a corner region of one neighboring unit area 2 by the second gap 2, with the vertex of the unit area 2 as a center. Here, the second gap G2 may have the same value as the center gap G0 between the second pixels 200 disposed in the center region of the unit area 2.

The unit area 2 includes the pair of second pixels 200 in the center region and the other pair of second pixels 200 in the corner region. As shown in FIG. 3, one of the pair of second pixels 200 in the center region and one of the pair of second pixels 200 in the corner region may be disposed on a first band B1 that extends along the x-direction and passes through a top or a bottom of the unit area 2, wherein the top and the bottom of the unit area 2 are divided with respect to the center point C of the unit area 2. Here, when a pixel is disposed on the first band B1, a center of the pixel is disposed on the first band B1. Pitches between the neighboring second pixels 200 disposed on the first band B1 may not unsystematic. For example, a first pitch pt1 and a second pitch pt2 may have different values.

The third pixels 300 included in the neighboring unit areas 2 may be disposed adjacent to each other at a third gap G3 with the vertex of the square shaped guideline 10 as a center. For example, the third pixel 300 of one unit area 2 may be disposed adjacent to the third pixel 300 of one neighboring unit area 2 in the x-direction by the third gap G3, with the third vertex P3 (or the fourth vertex P4) of the square shaped guideline 10 as a center.

As described above, since the plurality of unit areas 2 are disposed in the matrix shape, gaps between pixels configured to produce the same color included in the unit areas 2 disposed adjacent to each other may be the same. For example, the center gap G0, the first gap G1, the second gap G2, and the third gap G3 may be the same.

The second pixel 200 included in the unit area 2 may maintain the same interval from the first pixel 100 and the third pixel 300. For example, the second pixel 200 disposed in the center region of the unit area 2, i.e., in the center region of the square shaped guideline 10, may maintain a first distance D1 from the adjacent first pixel 100, and maintain a second distance D2 from the adjacent third pixel 300, wherein the first distance D1 and the second distance D2 may have the same value.

When the first and third pixels 100 and 300 disposed on the sides of the square shaped guideline 10 have different opening ratios, for example, when the first pixel 100 is increased, increasing the first width W1 rather than the first length L1 may be effective since the first pixel 100 has a strip shape. In this case, the first width W1 of the first pixel 100 may have a greater value than the third width W3 of the third pixel 300.

Figure 4:
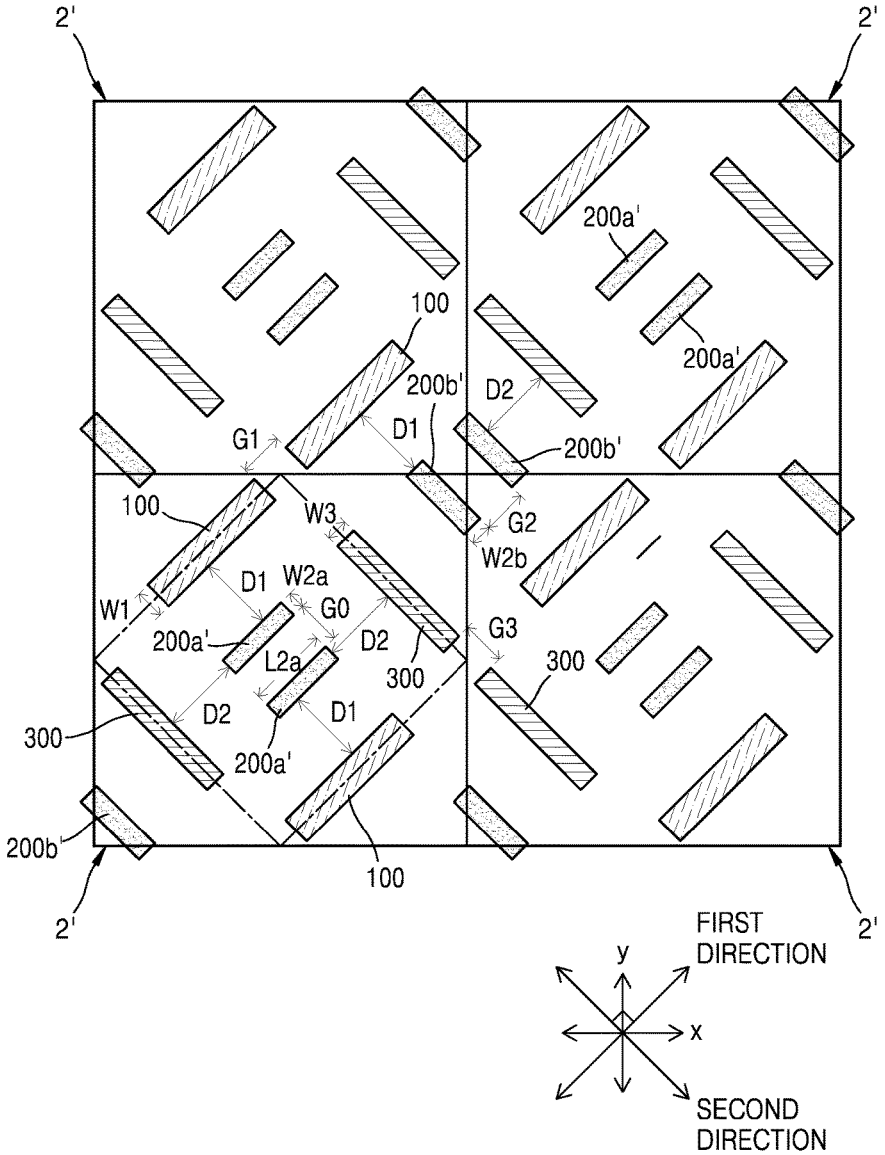
FIG. 4 is a plan view schematically illustrating an arrangement of pixels of a display device according to a comparative example.

Referring to FIG. 4, according to a comparative example, the first pixel 100 and a second pixel 200*a*' disposed in a center region are disposed parallel to each other, both extending in the first direction, and the first width W1 may be increased to increase the opening ratio of the first pixel 100.

In response, in order to maintain the first distance D1 between the first pixel 100 and the second pixel 200*a*' and the center gap G0 between the second pixels 200*a*', a second width W2*a* of the second pixel 200*a*' is decreased. Since the second pixel 200*a*' has a slot shape having a second length L2*a* larger than the second width W2*a*, when the second width W2*a* is decreased, the opening ratio is changed, i.e., decreased. In other words, the opening ratio of the second pixel 200*a*' deteriorates when the second width W2*a* is decreased compared to when the second length L2*a* is decreased.

Furthermore, the second pixel 200*a*' disposed in a center region of a unit area 2' extends in a direction different from an extending direction of a second pixel 200*b*' disposed in a corner region of the unit area 2', so the second pixels 200*a*' and 200*b*' which is configured to produce the same color, have different opening ratios from each other when the first width W1 of the first pixel 100 is increased, since a second width W2*b* of the second pixel 200*b*' in the corner region does not decrease but the second width W2*a* of the second pixel 200*a*' in the center region decreases.

According to the exemplary embodiments, as shown in FIGS. 2 and 3, the second pixel 200 extends along the second direction crossing, i.e., perpendicular to, the first pixel 100, so when the first width W1 increases, the second length L2 of the second pixel 200 is decreased, and thus, a deterioration of the opening ratio of the second pixel 200 may be reduced or prevented.

In addition, the second pixels 200 located in the center region and the corner region of the unit area 2 both extend in the second direction, a difference between the opening ratios of the second pixels 200 may be reduced or prevented compared to the comparative example referring to FIG. 4.

According to the exemplary embodiments described above, the first pixel 100 produces blue color and the third pixel 300 produces red color, but the exemplary embodiments are not limited thereto. According to an exemplary embodiment, the first pixel 100 may produce red color and the third pixel 300 may produce blue color.

In FIGS. 2 and 3, the first, second, and third pixels 100, 200, and through 300 have rectangular shape, but the exemplary embodiments are not limited thereto. If each of the first, second, and third pixels 100, 200, and 300 has a length that is greater than a width, each of the first, second, and third pixels 100, 200, and 300 may have any one of various shapes, such as parallelogons including a parallelogram, an elongated rhombus, a hexagon, etc.

As described above, pixels producing the same color are disposed adjacent to each other at certain gaps, and the first pixels 100 disposed on the display area DA extend along the first direction and the second and third pixels 200 and 300 disposed on the display area DA extend along the second direction, and thus, the opening ratio of the first, second, and third pixels and the resolution of the display device may be improved.

The display device according to one or more exemplary embodiments may reduce or prevent the deterioration of an opening ratio of the pixels and the imbalance of opening ratios of pixels producing the same color.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device comprising:

a plurality of unit areas, each of the plurality of unit areas comprising a first pixel, a second pixel, and a third pixel, wherein the first pixel, the second pixel, and the third pixel are configured to produce different colors, wherein each of the plurality of unit areas respectively comprises a square shaped guideline inscribed therein, the square shaped guideline comprising four vertices each disposed on one of four sides of the corresponding unit area, respectively, wherein the first pixel is disposed on a first side of the square shaped guideline, the first side and the first pixel extending in a first direction, wherein the second pixel is disposed in a center region of the square shaped guideline, the second pixel extending in a second direction, the second direction crossing the first direction perpendicularly, wherein the plurality of unit areas is arranged in a matrix shape along an x-direction and a y-direction, the y-direction crossing the x-direction perpendicularly, the first direction and the second direction being different from the x-direction and y-direction, and wherein the second pixel comprises a plurality of second pixels, and a number of the plurality of second pixels in each of the plurality of unit areas is equal to a sum of numbers of the first pixel and the third pixel in each of the plurality of unit areas, wherein the first pixel comprising a first length extending in the first direction, the second pixel comprising a second length extending in the second direction, and the third pixel comprising a third length extending in the second direction, the first length and the third length being greater than the second length, wherein the first pixel is configured to produce one color of a color group consisting of blue color and red color, and wherein the second pixel is configured to produce green color.

2. The display device of claim 1, wherein the first pixel of each of the plurality of unit areas comprises a pair of first pixels, wherein one of the pair of first pixels is disposed on the first side of the square shaped guideline and the other one of the pair of first pixels is disposed on a second side of the square shaped guideline, the second side disposed parallel to the first side.

3. The display device of claim 2, wherein the square shaped guideline comprises a first vertex disposed at one end of the first side and a second vertex disposed at one end of the second side facing the first vertex with respect to the center of the square shaped guideline, wherein one of the pair of first pixels is disposed adjacent to the first vertex and the other one of the pair of first pixels is disposed adjacent to the second vertex.

4. The display device of claim 1, wherein the second pixel of each of the plurality of unit areas comprises a pair of second pixels disposed in the center region of the square shaped guideline, wherein the pair of second pixels is disposed extending in the second direction spaced apart from each other with respect to a center point of the square shaped guideline.

5. The display device of claim 4, wherein the second pixel of each of the plurality of unit areas further comprises a pair of second pixels disposed outside the square shaped guideline and extending along the second direction.

6. The display device of claim 1, wherein the first pixel further comprises:

a first width the first length being greater than the first width, and wherein the second pixel further comprises:

a second width the second length being greater than the second width.

7. The display device of claim 6, wherein the third pixel is disposed on a third side of the square shaped guideline, the third side sharing a vertex with the first side and extending in the second direction.

8. The display device of claim 7, wherein the third pixel further comprises:

a third width the third length being greater than the third width, wherein an opening ratio of the first pixel is different from an opening ratio of the third pixel.

9. The display device of claim 8, wherein the first width of the first pixel is greater than the third width of the third pixel.

10. The display device of claim 7, wherein the third pixel comprises a pair of third pixels, wherein one of the pair of third pixels is disposed on the third side of the square shaped guideline and the other one of the pair of third pixels is disposed on a fourth side of the square shaped guideline, the fourth side disposed parallel to the third side.

11. The display device of claim 10, wherein the square shaped guideline comprises a third vertex disposed at one end of the third side and a fourth vertex disposed at one end of the fourth side facing the third vertex with respect to the center of the square shaped guideline, wherein one of the pair of third pixels is disposed adjacent to the third vertex and the other one of the pair of third pixels is disposed adjacent to the fourth vertex.

12. The display device of claim 1, wherein a distance between the first pixel and the second pixel disposed adjacent within each of the plurality of unit areas is equal to a distance between the third pixel and the second pixel disposed adjacent within each of the plurality of unit areas.

13. The display device of claim 1, wherein the plurality of unit areas comprises a first unit area and a second unit area disposed adjacent to each other, wherein a first pixel of the first unit area is disposed adjacent to a first pixel of the second unit area with one of the first vertex and the second vertex of the square shaped guideline therebetween.

14. The display device of claim 1, wherein the plurality of unit areas comprises a first unit area and a third unit area disposed adjacent to each other, wherein a third pixel of the first unit area is disposed adjacent to a third pixel of the third unit area with one of the first vertex and the third vertex of the square shaped guideline therebetween.

15. A display device comprising:

a plurality of unit areas, each of the plurality of unit areas comprising a first pixel, a second pixel, and a third pixel, wherein the first pixel, the second pixel, and the third pixel are configured to produce different colors, wherein each of the plurality of unit areas respectively comprises a square shaped guideline inscribed therein, the square shaped guideline comprising four vertices each disposed on one of four sides of the corresponding unit area, respectively, wherein the first pixel is disposed on a first side of the square shaped guideline, the first side and the first pixel extending in a first direction, wherein the second pixel is disposed in a center region of the square shaped guideline, the second pixel extending in a second direction, the second direction crossing the first direction perpendicularly, wherein the third pixel is disposed on a third side of the square shaped guideline, the third side sharing a vertex with the first side and extending in the second direction, wherein the second pixel of each of the plurality of unit areas further comprises a pair of second pixels disposed outside the square shaped guideline and extending along the second direction, wherein the plurality of unit areas is arranged in a matrix shape along an x-direction and a y-direction, the y-direction crossing the x-direction perpendicularly, the first direction and the second direction being different from the x-direction and y-direction, and wherein the second pixel comprises a plurality of second pixels, and a number of the plurality of second pixels in each of the plurality of unit areas is equal to a sum of numbers of the first pixel and the third pixel in each of the plurality of unit areas, wherein the first pixel comprising a first length extending in the first direction, the second pixel comprising a second length extending in the second direction, and the third pixel comprising a third length extending in the second direction, the first length and the third length being greater than the second length, wherein the first pixel is configured to produce one color of a color group consisting of blue color and red color, and wherein the second pixel is configured to produce green color.

16. The display device of claim 15, wherein the second pixel of each of the plurality of unit areas comprises a pair of second pixels disposed in the center region of the square shaped guideline, wherein the pair of second pixels is disposed extending in the second direction spaced apart from each other with respect to a center point of the square shaped guideline.

17. The display device of claim 15, wherein the first pixel further comprises:

a first width the first length being greater than the first width, and wherein the second pixel comprises:

a second width the second length being greater than the second width.

18. A display device comprising:

a plurality of unit areas, each of the plurality of unit areas comprising a pair of first pixels, a pair of second pixels, and a pair of third pixels, wherein the pair of first pixels, the pair of second pixels, and the pair of third pixels are configured to produce different colors, wherein the plurality of unit areas is arranged in a matrix shape along a x-direction and a y-direction, the y-direction crossing the x-direction perpendicularly, wherein each of the plurality of unit areas respectively comprises a square shaped guideline inscribed therein, the square shaped guideline comprising four vertices each disposed on one of four sides of the corresponding unit area, respectively, wherein one of the pair of first pixels is disposed on a first side of the square shaped guideline and the other one of the pair of first pixels is disposed on a second side of the square shaped guideline, the second side disposed parallel to the first side, the first side and the pair of first pixels extending in a first direction, wherein the pair of second pixels is disposed extending in a second direction spaced apart from each other with respect to a center point of the square shaped guideline, the second direction crossing the first direction perpendicularly, wherein one of the pair of third pixels is disposed on the third side of the square shaped guideline and the other one of the pair of third pixels is disposed on a fourth side of the square shaped guideline, the fourth side disposed parallel to the third side, the third side and the pair of third pixels extending in the second direction, wherein the first direction and the second direction being different from the x-direction and y-direction, and wherein the second pixel comprises a plurality of second pixels, and a number of the plurality of second pixels in each of the plurality of unit areas is equal to a sum of numbers of the first pixel and the third pixel in each of the plurality of unit areas, wherein the first pixel comprising a first length extending in the first direction, the second pixel comprising a second length extending in the second direction, and the third pixel comprising a third length extending in the second direction, the first length and the third length being greater than the second length, wherein the first pixel is configured to produce one color of a color group consisting of blue color and red color, and wherein the second pixel is configured to produce green color.

* * * * *